US010826201B2

(12) United States Patent
Fujiki

(10) Patent No.: US 10,826,201 B2
(45) Date of Patent: Nov. 3, 2020

(54) CONDUCTIVE MEMBER

(71) Applicant: SUMITOMO WIRING SYSTEMS, LTD., Yokkaichi (JP)

(72) Inventor: Masashi Fujiki, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 143 days.

(21) Appl. No.: 16/095,834

(22) PCT Filed: Apr. 11, 2017

(86) PCT No.: PCT/JP2017/014741
§ 371 (c)(1),
(2) Date: Oct. 23, 2018

(87) PCT Pub. No.: WO2017/187954
PCT Pub. Date: Nov. 2, 2017

(65) Prior Publication Data

US 2019/0288407 A1 Sep. 19, 2019

(30) Foreign Application Priority Data

Apr. 25, 2016 (JP) ..... 2016-086806

(51) Int. Cl.
*H01R 4/18* (2006.01)
*H01B 7/00* (2006.01)
(Continued)

(52) U.S. Cl.
CPC ..... *H01R 4/186* (2013.01); *H01B 7/0081* (2013.01); *H01B 7/04* (2013.01); *H01R 4/18* (2013.01);
(Continued)

(58) Field of Classification Search
CPC combination set(s) only.
See application file for complete search history.

(56) References Cited

U.S. PATENT DOCUMENTS 1,575,994 A * 3/1926 Laise ..... C03C 27/046 174/50.61
2,008,227 A * 7/1935 Ward ..... F16G 11/02 403/284
(Continued)

FOREIGN PATENT DOCUMENTS

JP S36-1124 Y1 1/1961
JP 2010-146739 A 7/2010
(Continued)

OTHER PUBLICATIONS

Jun. 20, 2017 International Search Report issued in International Patent Application No. PCT/JP2017/014741.

*Primary Examiner* — Binh B Tran
*Assistant Examiner* — Krystal Robinson
(74) *Attorney, Agent, or Firm* — Oliff PLC

(57) ABSTRACT

A conductive member that includes a flexible conductor in which a plurality of strands are bundled together and that has flexibility; a rigid conductor that has a shape retaining property; a body that is formed at an end portion of the rigid conductor and that surrounds the flexible conductor and is fixed to the flexible conductor; and a sliding contact that has a form protruding from an inner circumference of the body and with which the strands can make sliding contact, wherein the sliding contact has a bent shape.

4 Claims, 4 Drawing Sheets

(51) Int. Cl.
*H01B 7/04* (2006.01)
*H01R 4/20* (2006.01)
*H01R 43/048* (2006.01)
*H01R 43/16* (2006.01)

(52) U.S. Cl.
CPC ..... *H01R 4/206* (2013.01); *H01R 43/048* (2013.01); *H01R 43/16* (2013.01)

(56) References Cited

U.S. PATENT DOCUMENTS 2,640,095 A * 5/1953 Lewis ..... H02G 15/085 174/88 C
2,815,497 A * 12/1957 Redslob ..... H01R 4/62 439/203
2,868,863 A * 1/1959 Cook ..... H01R 4/62 174/94 R
2,937,228 A * 5/1960 Robinson ..... H02G 15/085 174/88 C
3,447,821 A * 6/1969 Bochory ..... F16B 19/02 285/148.27
3,568,130 A * 3/1971 Hurst ..... H01R 4/62 439/161
3,931,726 A * 1/1976 Grubb ..... B21J 7/26 72/430
3,990,143 A * 11/1976 Dittmann ..... H01R 4/188 29/865
3,996,417 A * 12/1976 Annas ..... H01R 4/20 174/90
4,018,976 A * 4/1977 Grove ..... H01B 7/29 174/19
4,086,427 A * 4/1978 Nasuta, Jr. ..... H01R 9/05 174/78
4,199,653 A * 4/1980 Talley ..... H01R 9/11 174/15.7
4,442,182 A * 4/1984 Chart ..... H01R 11/26 148/527
4,556,265 A * 12/1985 Cunningham ..... H01R 24/40 333/260
4,828,516 A * 5/1989 Shaffer ..... H01R 43/058 29/863
5,188,544 A * 2/1993 Mukai ..... H01R 11/12 439/287
5,496,968 A * 3/1996 Katoh ..... H01R 4/183 174/19
5,526,549 A * 6/1996 Mori ..... F16L 5/02 16/2.1
5,527,994 A * 6/1996 Kasper ..... H01B 7/425 174/74 R
5,749,756 A * 5/1998 Vockroth ..... H01R 4/203 174/84 C
5,847,320 A * 12/1998 Fisher ..... H01R 4/12 174/87
6,160,216 A * 12/2000 McMahon ..... H01B 7/0045 174/102 R
6,658,735 B2 * 12/2003 Ito ..... H01R 4/183 174/84 C
6,995,316 B1 * 2/2006 Goto ..... H02G 15/013 16/2.1
7,256,348 B1 * 8/2007 Endacott ..... H01R 4/183 174/84 C
7,600,721 B2 * 10/2009 Vermeer ..... H02G 1/14 140/123
7,972,183 B1 * 7/2011 Lin ..... H01R 13/6463 439/676
8,205,786 B1 * 6/2012 Holden ..... B23K 1/19 228/180.5
8,350,155 B2 * 1/2013 Kobayashi ..... H01R 4/186 174/84 R
8,585,447 B2 * 11/2013 Drew ..... H01R 43/16 439/843
9,396,840 B2 * 7/2016 Mizutani ..... H02G 3/0481
9,917,434 B2 * 3/2018 George ..... H02G 15/113
9,985,362 B2 * 5/2018 Arenburg ..... H01R 11/12
10,312,673 B2 * 6/2019 Hagi ..... H05K 9/0073
10,625,693 B2 * 4/2020 Nakaizumi ..... H02G 3/0481
2004/0074667 A1 * 4/2004 Endacott ..... H01R 43/048 174/84 R
2005/0153603 A1 * 7/2005 AbuGhazaleh .... H01R 13/6463 439/676
2010/0048051 A1 * 2/2010 Melni ..... H01R 4/12 439/271
2010/0096184 A1 * 4/2010 Ambo ..... B60R 16/0215 174/72 A
2010/0147585 A1 6/2010 Kobayashi et al.
2012/0273253 A1 * 11/2012 Nilsson ..... C08F 6/001 174/120 SC
2013/0248246 A1 * 9/2013 Oga ..... B60R 16/0207 174/72 A
2013/0269981 A1 * 10/2013 Shiga ..... B60R 16/0215 174/136
2016/0071630 A1 * 3/2016 Sugino ..... H01R 4/021 174/68.3
2016/0322124 A1 * 11/2016 Englund ..... H01B 7/0275

FOREIGN PATENT DOCUMENTS

JP 2010-176886 A 8/2010
JP 2015-088251 A 5/2015
JP 2016-018672 A 2/2016

* cited by examiner

CONDUCTIVE MEMBER

This application is the U.S. National Phase of PCT/JP2017/014741 filed Apr. 11, 2017, which claims priority to JP 2016-086806 filed Apr. 25, 2016, the entire disclosure of which is incorporated herein by reference.

BACKGROUND

The present disclosure relates to a conductive member.

JP 2015-88251A discloses a conductive member including a pipe that has a shape retaining property and a coated electric wire that has flexibility, as a means for routing wires between devices such as a battery, a motor, and an inverter apparatus in a vehicle such as an electric automobile or a hybrid automobile. To connect the pipe and a core wire of the coated electric wire to each other, a method is adopted in which an end portion of the core wire is inserted into an end portion of the pipe, and the end portions of the pipe and the core wire are flattened together.

SUMMARY

With the above-described connection method, in the case where the pipe or the core wire is made of aluminum, an oxide film on the surface thereof cannot be sufficiently removed. In particular, in the case where the core wire is composed of a stranded wire constituted by a plurality of strands made of aluminum, removal of the oxide films is largely impossible. If oxide films remain unremoved, the contact resistance between the pipe and the core wire increases, and there is a problem in terms of contact reliability.

An exemplary aspect of the disclosure improvides the contact reliability.

A conductive member of an embodiment of the present disclosure includes: a flexible conductor in which a plurality of strands are bundled together and that has flexibility; a rigid conductor that has a shape retaining property; a body that is formed at an end portion of the rigid conductor and that surrounds the flexible conductor and is fixed to the flexible conductor; and a sliding contact that has a form protruding from an inner circumference of the body and with which the strands can make sliding contact, wherein the sliding contact has a bent shape.

In a state before the body is fixed to the flexible conductor, when the flexible conductor is inserted into the body, oxide films on some of the strands are removed as a result of these strands making sliding contact with the inner circumferential surface of the body, and oxide films on other strands are removed as a result of these strands making sliding contact with the sliding contact. The oxide films are removed in at least one of a step of inserting the flexible conductor into the body and a step of fixing the flexible conductor to the body. Since the sliding contact is provided, the number of strands from which oxide films are removed is increased. Thus, the contact resistance between the flexible conductor and the rigid conductor is reduced, and the contact reliability is improved.

DETAILED DESCRIPTION OF EMBODIMENTS

In the conductive member of the present invention, the rigid conductor may include a tubular main body that constitutes a region extending over substantially the entire length thereof excluding the fixation portion (which is an example of the "body"), and a tubular terminal member that is disposed at an end portion of the rigid conductor and that constitutes the fixation portion. With this configuration, an area of the rigid conductor where the sliding contact portion (which is an example of the "sliding contact") is formed can be limited to only the fixation portion into which the flexible conductor is to be inserted. Thus, the weight of the rigid conductor can be reduced, and the material cost can be reduced.

In the conductive member of the present invention, protruding end portions of a plurality of the sliding contact portions may be joined together. With this configuration, the maximum protruding length of each of the sliding contact portions can be ensured, and thus, the number of strands that make sliding contact with the sliding contact portions can be increased.

In the conductive member of the present invention, the sliding contact portion may have a bent shape. With this configuration, when the fixation portion is plastically deformed and fixed to the flexible conductor, the sliding contact portion can easily deform, and thus, the shape of the fixation portion after being fixed is stabilized.

In the conductive member of the present invention, the rigid conductor may have a tubular shape over the entire length thereof, and the sliding contact portion may be formed on the inner circumference of the rigid conductor over the entire length of the rigid conductor. With this configuration, the entire rigid conductor including the sliding contact portion can be manufactured as a single unit by simply performing extrusion molding.

Embodiment 1

Figure 1:
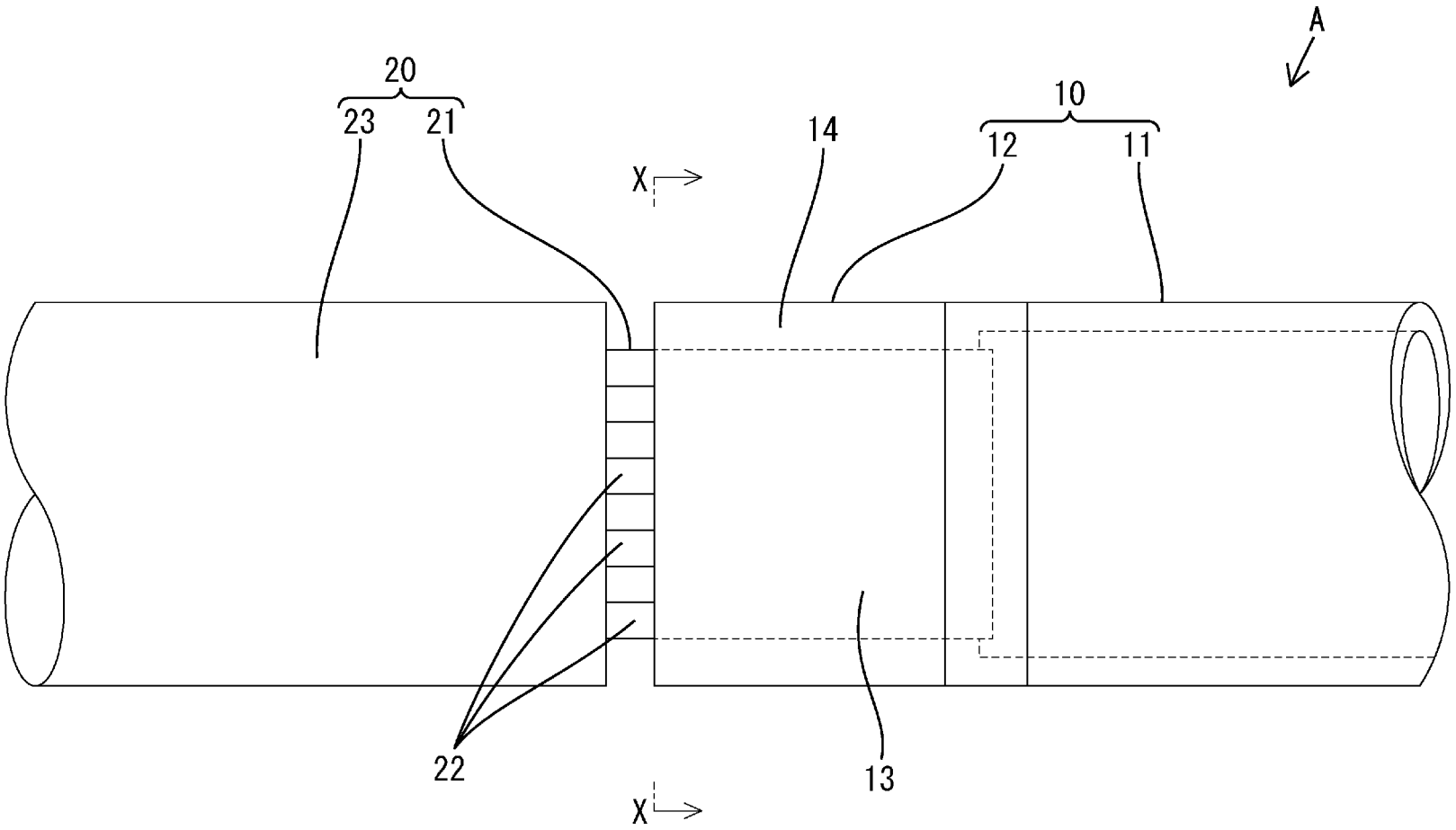
FIG. 1 is a partial side view of a conductive member of Embodiment 1.
Figure 2:
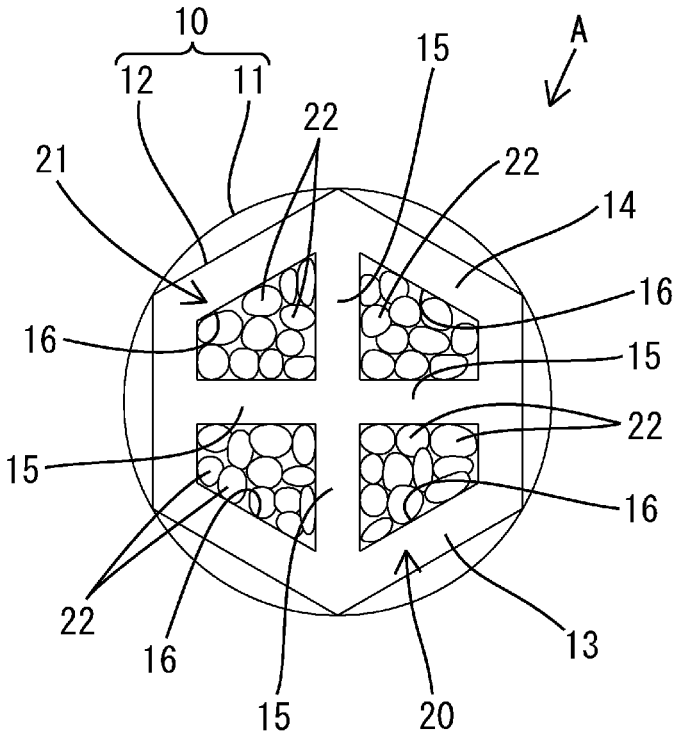
FIG. 2 is a cross-sectional view taken along line X-X in FIG. 1.
Figure 3:
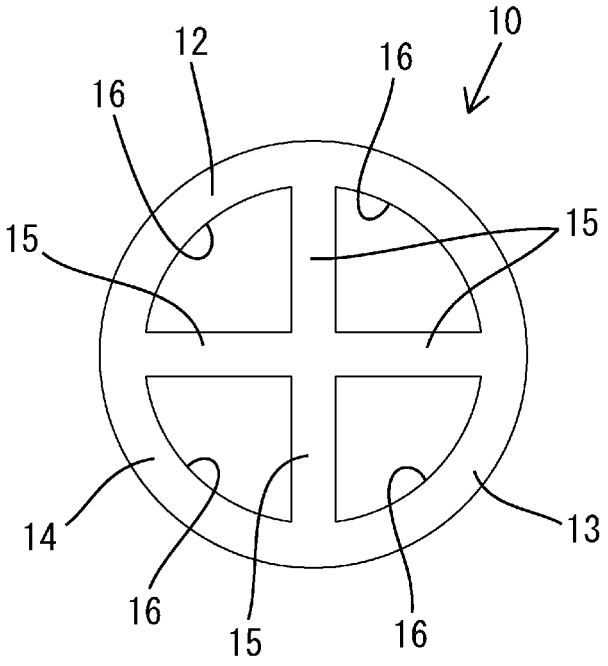
FIG. 3 is a front view of a rigid conductor, showing a state in which a coated conductor is not yet connected thereto.

Hereinafter, Embodiment 1 of the present disclosure will be described with reference to FIGS. 1 to 3. A conductive member A of Embodiment 1 is used as a means for routing wires between devices (not shown) such as a battery, a motor, and an inverter apparatus in a vehicle such as an electric automobile or a hybrid automobile. The conductive member A includes a rigid conductor 10 and a coated conductor 20 that has flexibility.

The rigid conductor 10 is composed of a pipe made of aluminum or an aluminum alloy and has a shape retaining property, which is the property of not easily deforming due to its stiffness. The rigid conductor 10 is bent into a predetermined shape and is arranged so as to extend along an under-floor area of the vehicle. The rigid conductor 10 includes a tubular main body 11 that has a circular cross-sectional shape over the entire length thereof, and a pair of tubular terminal members 12 that are fixed to front and rear end portions, respectively, of the tubular main body 11. The tubular main body 11 is an elongated member that constitutes most of the region of the rigid conductor 10 excluding the end portions. The inner circumference of the tubular main body 11 has a substantially perfectly circular cross-sectional shape, and no projecting portions or the like are formed on the inner circumference of the tubular main body 11.

Each tubular terminal member 12 has the function of a fixation portion 13 that serves as a means for connection to a coated conductor 20. Each tubular terminal member 12 is a single component that has a tubular main body portion 14 and four sliding contact portions 15 protruding inward in a radial direction from the inner circumference of the main body portion 14. As shown in FIG. 3, in a state before the coated conductor 20 (flexible conductor 21) is connected to the rigid conductor 10 (fixation portion 13), the main body portion 14 has a cylindrical shape whose outer diameter and inner diameter are the same as those of the tubular main body 11.

Each tubular terminal member 12 and the tubular main body 11 are integrated by coaxially fixing an end surface of the main body portion 14 and an end surface of the tubular main body 11 to each other through laser welding or the like. When the rigid conductor 10 and the coated conductor 20 are connected to each other, the main body portion 14 is plastically deformed into a substantially regular hexagonal shape (regular polygonal shape) through crimping (see FIG. 2).

In a state in which the main body portion 14 is not yet crimped (a state in which the rigid conductor 10 and the coated conductor 20 are not yet connected), the four sliding contact portions 15 are equiangularly arranged in a circumferential direction of the main body portion 14. It should be noted that, although the number of sliding contact portions 15 is four in Embodiment 1, the number of sliding contact portions 15 may be three or less or may be five or more. In a cross section that is cut at a right angle to the axis of the rigid conductor 10, each sliding contact portion 15 has a shape that linearly extends in the radial direction toward the center of the main body portion 14.

Each sliding contact portion 15 has the form of a wall, and is formed to be continuous over the entire length of the main body portion 14 (tubular terminal member 12). Protruding end portions of the four sliding contact portions 15 are joined together at a center portion of the main body portion 14 so as to form the shape of a cross. Accordingly, in a state in which the rigid conductor 10 and the coated conductor 20 are not yet connected, the inside of the hollow portion of the tubular terminal member 12 (fixation portion 13) is divided into four connection spaces 16 that each have a quarter-circular arc shape.

The coated conductor 20 includes the flexible conductor 21 (core wire) that is obtained by twisting a plurality of strands 22 together, and an insulating coating 23 that surrounds the flexible conductor 21 over the entire circumference thereof. The strands 22 (flexible conductor 21) are made of aluminum or an aluminum alloy. That is to say, the flexible conductor 21 of the coated conductor 20 is made of the same material as the rigid conductor 10. At an end portion of the coated conductor 20 that is connected to the rigid conductor 10 (fixation portion 13), the insulating coating 23 is removed, and the flexible conductor 21 is exposed.

To connect the coated conductor 20 to the rigid conductor 10, first, the insulating coating 23 at the end portion of the coated conductor 20 is removed to expose the flexible conductor 21. Then, in the exposed portion of the flexible conductor 21, the strands 22 are untwisted and brought into a state in which the strands 22 are substantially straightened out and bundled together. Next, the flexible conductor 21 is divided into four portions, and the divided portions of the flexible conductor 21 (bundles of strands 22) are individually inserted into the four respective connection spaces 16 of the fixation portion 13 (tubular terminal member 12).

In the course of insertion, the strands 22 make sliding contact with inner wall surfaces of the connection spaces 16. That is to say, the strands 22 make sliding contact with an inner circumferential surface of the main body portion 14, and also the strands 22 make sliding contact with the sliding contact portions 15. This sliding contact scrapes off oxide films (not shown) on the surfaces of the strands 22, an oxide film (not shown) on the inner circumferential surface of the main body portion 14, and oxide films (not shown) on the surfaces of the sliding contact portions 15. After the oxide films on the strands 22 and the tubular terminal member 12 have been removed in this manner, the main body portion 14 is plastically deformed from the circular shape into a regular hexagonal shape.

At this time, the main body portion 14 deforms such that its diameter decreases. Therefore, the volumes (cross-sectional areas) of the connection spaces 16 decrease, the main body portion 14 and the sliding contact portions 15 come into intimate contact with the bundles of the strands 22 so as to compress the bundles of the strands 22 in the radial direction and the circumferential direction, and thus, the flexible conductor 21 and the fixation portion 13 (rigid conductor 10) are fixed to each other. In this fixing step as well, the oxide films on the surfaces of the strands 22, the oxide film on the inner circumferential surface of the main body portion 14, and the oxide films on the surfaces of the sliding contact portions 15 are scraped off as in the above-described inserting step. As a result, the flexible conductor 21 of the coated conductor 20 and the rigid conductor 10 are connected to each other in a state in which electrical conduction can be established and disconnection from each other is restrained.

The conductive member A of Embodiment 1 includes the coated conductor 20, into which the flexible conductor 21 in which the plurality of strands 22 are bundled together and the insulating coating 23 surrounding the flexible conductor 21 are integrated and which has flexibility, and the rigid conductor 10, which has a shape retaining property. The fixation portion 13, which surrounds the flexible conductor 21 and is fixed to the flexible conductor 21 such that electrical conduction can be established, is formed at an end portion of the rigid conductor 10. Moreover, the rigid conductor 10 includes the sliding contact portions 15, which have a form protruding from the inner circumference of the fixation portion 13 and with which the strands 22 can make sliding contact.

When the flexible conductor 21 is inserted into the fixation portion 13 in a state before the fixation portion 13 is fixed to the flexible conductor 21, the oxide films on some of the strands 22 are removed as a result of these strands 22 making sliding contact with the inner circumferential surface of the fixation portion 13, and the oxide films on other strands 22 are removed as a result of these strands 22 making sliding contact with the sliding contact portions 15. Since the sliding contact portions 15 are provided, the number of strands 22 from which the oxide films will be removed is increased. Thus, the contact resistance between the flexible conductor 21 and the rigid conductor 10 is reduced, and the contact reliability therebetween is improved.

Moreover, the rigid conductor 10 includes the tubular main body 11, which constitutes a region of the rigid conductor 10 that extends over almost the entire length of the rigid conductor 10 excluding the fixation portions 13, and the tubular terminal members 12, which are disposed at the respective end portions of the rigid conductor 10 and constitute the respective fixation portions 13. With this configuration, it is possible to limit areas of the rigid conductor 10 where the sliding contact portions 15 are formed to only the fixation portions 13, into which corresponding flexible conductors 21 are to be inserted. Thus, a reduction in the weight of the rigid conductor 10 and a reduction in the material cost are realized.

Moreover, since the protruding end portions of the four (a plurality of) sliding contact portions 15 are joined together, the maximum protruding length of the sliding contact portions 15 can be ensured. Thus, the number of strands 22 that make sliding contact with the sliding contact portions 15 can be increased.

Embodiment 2

Figure 4:
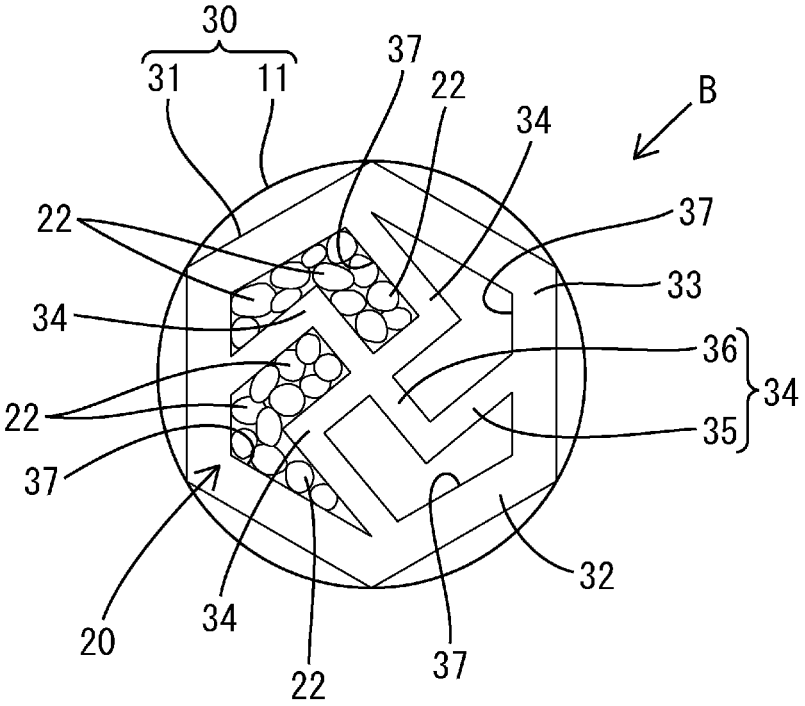
FIG. 4 is a cross-sectional view of a conductive member of Embodiment 2 taken along a line corresponding to the line X-X.

Next, Embodiment 2 of the present disclosure will be described with reference to FIG. 4. A conductive member B of Embodiment 2 has a configuration in which the shape of sliding contact portions 34 of a tubular terminal member 31 (fixation portion 32) that constitutes a rigid conductor 30 is different from that of Embodiment 1 above. The other configurations are the same as those of Embodiment 1 above. For this reason, like constituent elements are denoted by like reference numerals, and the description of structures and effects of those constituent elements is omitted.

The tubular terminal member 31 of Embodiment 2 is a single component that has a tubular main body portion 33 and four sliding contact portions 34 protruding inward in the radial direction from the inner circumference of the main body portion 33. In a state before the coated conductor 20 is connected to the rigid conductor 30, the main body portion 33 has a cylindrical shape whose outer diameter and inner diameter are the same as those of the tubular main body. The tubular terminal member 31 and the tubular main body are integrated by coaxially fixing an end surface of the main body portion 33 and an end surface of the tubular main body to each other through laser welding or the like. In the step of connecting the rigid conductor 30 and the coated conductor 20 to each other, the main body portion 33 is plastically deformed into a substantially regular hexagonal shape (regular polygonal shape) through crimping.

In a state in which the main body portion 33 is not yet crimped (a state in which the rigid conductor 30 and the coated conductor 20 are not yet connected), the four sliding contact portions 34 are equiangularly arranged in the circumferential direction of the main body portion 33. It should be noted that, although the number of sliding contact portions 34 is four in Embodiment 2, the number of sliding contact portions 34 may be three or less or may be five or more. Each sliding contact portion 34 has the form of a bent wall, and is formed to be continuous over the entire length of the main body portion 33 (tubular terminal member 31).

In a cross section that is cut at a right angle to the axis of the rigid conductor 30, each sliding contact portion 34 has a shape (not shown) that is bent at an obtuse angle. That is to say, one sliding contact portion 34 is constituted by a circumferential edge-side wall portion 35 that protrudes obliquely in the radial direction from the inner circumference of the main body portion 33, and a center-side wall portion 36 that protrudes from a protruding end edge of the circumferential end-side wall portion toward the center of the main body portion 33. The circumferential edge-side wall portion 35 and the center-side wall portion 36 are obliquely connected to each other.

Moreover, the four sliding contact portions 34 are joined together at a center portion of the main body portion 33. That is to say, protruding end portions of the four center-side wall portions 36 are joined together so as to form the shape of a cross. Thus, the inside of the hollow portion of the tubular terminal member 31 (fixation portion 32) is divided into four connection spaces 37. When the bundles of the strands 22 are inserted into the respective connection spaces 37, the strands 22 make sliding contact with the circumferential edge-side wall portions 35 and the center-side wall portions 36, and thus, the oxide films (not shown) on the strands 22, the main body portion 33, and the sliding contact portions 34 are scraped off.

In the step of connecting the flexible conductor 21 of the coated conductor 20 and the rigid conductor 30 to each other, when the main body portion 33 is plastically deformed from the circular shape to a regular hexagonal shape, each sliding contact portion 34 bends and deforms such that the angle between the circumferential edge-side wall portion 35 and the center-side wall portion 36 decreases. Accordingly, the volumes of the connection spaces 37 decrease, and the main body portion 33 and the sliding contact portions 34 thus come into intimate contact with the bundles of the strands 22 so as to compress the bundles of strands 22 in the radial direction and the circumferential direction. As a result, the flexible conductor 21 of the coated conductor 20 and the rigid conductor 30 are connected to each other in a state in which electrical conduction can be established and disconnection from each other is restrained.

In the conductive member B of Embodiment 2, since the protruding end portions of the four (a plurality of) sliding contact portions 34 are joined together, the maximum protruding length of the sliding contact portions 34 can be ensured. In addition, since each sliding contact portion 34 has a bent shape, the number of strands 22 that make sliding contact with the sliding contact portions 34 can be increased. Moreover, since the four sliding contact portions 34, which are joined together, each have a bent shape, when the fixation portion 32 is plastically deformed and fixed to the flexible conductor 21, the sliding contact portions 34 can easily bend. Therefore, the shape of the fixation portion 32 (tubular terminal member 31) after being fixed is stabilized.

Embodiment 3

Figure 5:
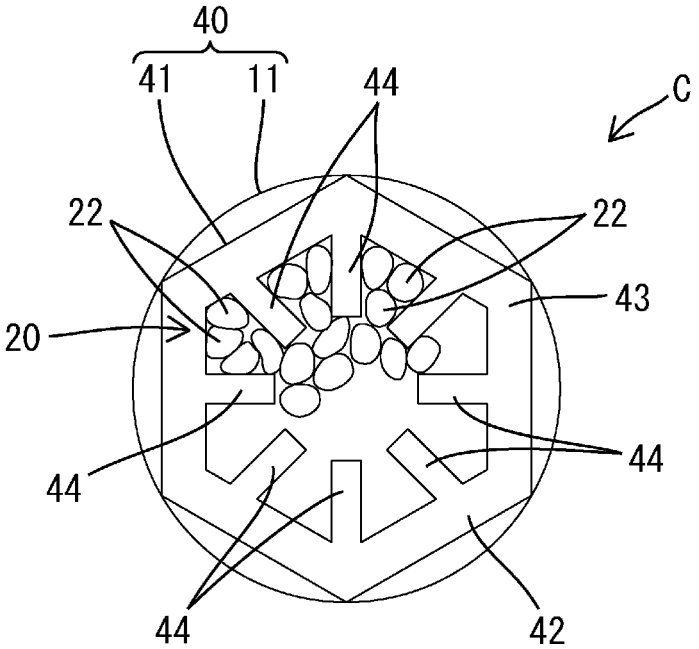
FIG. 5 is a cross-sectional view of a conductive member of Embodiment 3 taken along a line corresponding to the line X-X.

Next, Embodiment 3 of the present disclosure will be described with reference to FIG. 5. A conductive member C of Embodiment 3 has a configuration in which the shape of sliding contact portions 44 of a tubular terminal member 41 (fixation portion 42) that constitutes a rigid conductor 40 is different from that of Embodiment 1 above. The other configurations are the same as those of Embodiment 1 above. For this reason, like constituent elements are denoted by like reference numerals, and the description of structures and effects of those constituent elements is omitted.

The tubular terminal member 41 (fixation portion 42) of Embodiment 3 includes a main body portion 43 that has a circular shape in a state in which the rigid conductor 40 and the coated conductor 20 are not yet connected, and a plurality of (e.g., eight) sliding contact portions 44 that are equiangularly arranged on the inner circumference of the main body portion 43 in the circumferential direction. Each sliding contact portion 44 has the form of a wall that linearly protrudes inward in the radial direction from the inner circumference toward the center of the main body portion 43.

The protruding length of each sliding contact portion 44 is set to be smaller than the radius of the main body portion 43 in the state of having a circular shape. The distance between adjacent sliding contact portions 44 in the circumferential direction is set to be larger than the outer diameter of one strand 22. Therefore, a plurality of strands 22 are accommodated between adjacent sliding contact portions 44. Moreover, even in a state in which the rigid conductor 40 and the coated conductor 20 have been connected to each other, and the main body portion 43 has plastically deformed into a regular hexagonal shape, protruding end portions of the sliding contact portions 44 still do not come into contact with one another.

Embodiment 4

Figure 6:
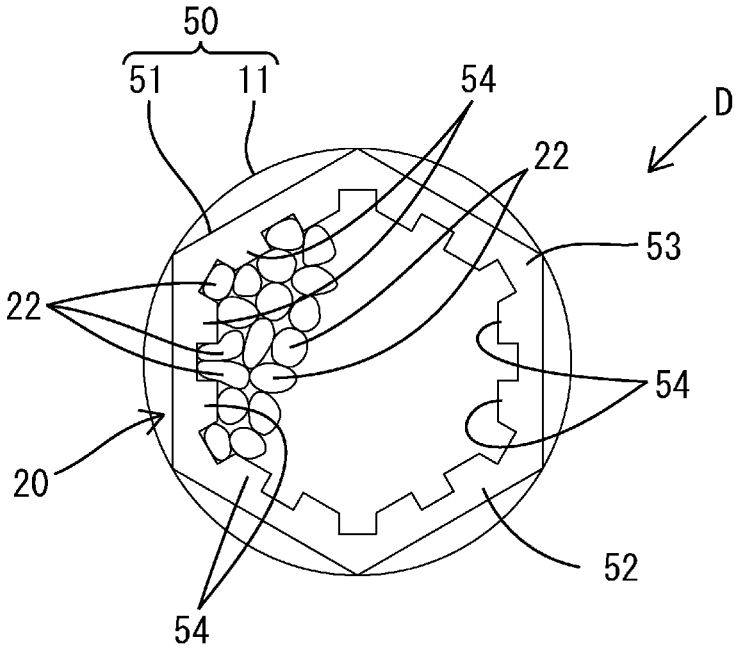
FIG. 6 is a cross-sectional view of a conductive member of Embodiment 4 taken along a line corresponding to the line X-X.

Next, Embodiment 4 of the present disclosure will be described with reference to FIG. 6. A conductive member D of Embodiment 4 has a configuration in which the shape of sliding contact portions 54 of a tubular terminal member 51 (fixation portion 52) that constitutes a rigid conductor 50 is different from that of Embodiment 1 above. The other configurations are the same as those of Embodiment 1 above. For this reason, like constituent elements are denoted by like reference numerals, and the description of structures and effects of those constituent elements is omitted.

The tubular terminal member 51 (fixation portion 52) of Embodiment 4 includes a main body portion 53 that has a circular shape in a state in which the rigid conductor 50 and the coated conductor 20 are not yet connected, and a plurality of (e.g., twelve) sliding contact portions 54 that are equiangularly arranged on the inner circumference of the main body portion 53 in the circumferential direction. Each sliding contact portion 54 has the form of a rib that protrudes inward in the radial direction from the inner circumference of the main body portion 53.

That is to say, the protruding dimension of each sliding contact portion 54 in the radial direction and the distance between adjacent sliding contact portions 54 in the circumferential direction are set to be substantially equal to each other. Moreover, the protruding dimension of each sliding contact portion 54 is set to be substantially equal to the outer diameter of one strand 22. This means that only one or two strands 22 can be accommodated between adjacent sliding contact portions 54. Therefore, to connect the rigid conductor 50 and the coated conductor 20 to each other, the flexible conductor 21 can be inserted into the tubular terminal member 51 (fixation portion 52) with the strands 22 still twisted (in a state in which the strands 22 are not untwisted).

Other Embodiments

The present disclosure is not limited to the embodiments that have been described above using the drawings, and embodiments as described below, for example, are also embraced within the technical scope of the present invention.

(1) According to Embodiments 1 to 4 above, the rigid conductor is constituted by the tubular main body and the tubular terminal member. However, a configuration may also be adopted in which the rigid conductor has a tubular shape over the entire length thereof, and sliding contact portions protruding from the inner circumference of the rigid conductor are formed over the entire length of the rigid conductor. With this configuration, the entire rigid conductor including the sliding contact portions can be manufactured as a single unit by simply performing extrusion molding.

(2) According to Embodiments 1 to 4 above, the sliding contact portions are integrally formed on the inner circumference of the fixation portion (tubular terminal member). However, a configuration may also be adopted in which sliding contact portions that are formed as components separate from the fixation portion are fixed to the inner circumference of the fixation portion.

(3) According to Embodiments 1 to 4 above, the rigid conductor is made of aluminum or an aluminum alloy. However, a configuration may also be adopted in which the rigid conductor is made of a material (copper, a copper alloy, or the like) other than aluminum and an aluminum alloy.

(4) According to Embodiments 1 to 4 above, the flexible conductor is made of aluminum or an aluminum alloy. However, a configuration may also be adopted in which the flexible conductor is made of a material (copper, a copper alloy, or the like) other than aluminum and an aluminum alloy.

(5) According to Embodiments 1 to 4 above, the rigid conductor and the flexible conductor of the coated conductor are made of the same material. However, a configuration may also be adopted in which the rigid conductor and the flexible conductor are made of different materials.

(6) According to Embodiments 1 to 4 above, strands on at least one side are accommodated between adjacent sliding contact portions in the circumferential direction. However, the present disclosure is not limited to this configuration, and a configuration may also be adopted in which the inner circumference of the main body portion is knurled so that a plurality of sliding contact portions are lined up in the circumferential direction at a pitch that is smaller than the outer diameter of a strand. In this case as well, the flexible conductor can be inserted into the fixation portion without the need to untwist the strands as in Embodiment 4.

(7) According to Embodiments 1 to 4 above, in a state before the coated conductor (flexible conductor) is connected to the rigid conductor (fixation portion), the main body portion and the tubular main body have a circular cross-sectional shape. However, a configuration may also be adopted in which the main body portion and the tubular main body have a non-circular cross-sectional shape.

(8) According to Embodiments 1 to 4 above, the rigid conductor has the form of a hollow pipe. However, a region of the rigid conductor excluding the fixation portions (tubular terminal members) may have the form of a solid rod.

(9) According to Embodiments 1 to 4 above, oxide films are removed in both the step of inserting the flexible conductor into the fixation portion and the step of fixing the flexible conductor to the fixation portion. However, a configuration may also be adopted in which oxide films are removed in only one of the inserting step and the fixing step.

The invention claimed is:

1. A conductive member comprising:

a flexible conductor including a plurality of strands bundled together, the flexible conductor having flexibility;

a rigid conductor having a shape retaining property;

a body formed at an end portion of the rigid conductor, the body surrounding the flexible conductor and fixed to the flexible conductor; and a plurality of sliding contacts formed on an inner circumferential surface of the body of the rigid conductor and protruding inward from the inner circumference of the body, the plurality of sliding contacts configured to make sliding contact with the plurality of strands, the plurality of sliding contacts having a bent shape and extending inward.

2. The conductive member according to claim 1, wherein the rigid conductor includes a tubular main body that forms a region extending over an entire length of the rigid conductor excluding the body, and a tubular terminal that is disposed at the end portion of the rigid conductor and that forms the body.

3. The conductive member according to claim 1, wherein protruding ends of the plurality of sliding contacts are joined together.

4. The conductive member according to claim 1, wherein:

the rigid conductor has a tubular shape over an entire length of the rigid conductor, and the plurality of sliding contacts are formed on an inner circumference of the rigid conductor over an entire length of the rigid conductor.

* * * * *